US012268340B2

(12) United States Patent
Lewis

(10) Patent No.: US 12,268,340 B2
(45) Date of Patent: Apr. 8, 2025

(54) PAPER PRODUCT DISPENSER WITH IMPROVED DISPENSING

(71) Applicant: Kimberly-Clark Worldwide, Inc., Neenah, WI (US)

(72) Inventor: Richard P. Lewis, Fort Myers, FL (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 219 days.

(21) Appl. No.: 17/796,667

(22) PCT Filed: Jan. 31, 2020

(86) PCT No.: PCT/US2020/016148
§ 371 (c)(1),
(2) Date: Jul. 31, 2022

(87) PCT Pub. No.: WO2021/154286
PCT Pub. Date: Aug. 5, 2021

(65) Prior Publication Data

US 2023/0056982 A1 Feb. 23, 2023

(51) Int. Cl.
*A47K 10/36* (2006.01)

(52) U.S. Cl.
CPC ..... *A47K 10/36* (2013.01); *A47K 10/3656* (2013.01); *A47K 2010/3668* (2013.01)

(58) Field of Classification Search
None
See application file for complete search history.

(56) References Cited

U.S. PATENT DOCUMENTS

| | | | |
|---|---|---|---|
| 6,412,679 | B2 | 7/2002 | Formon et al. |
| 7,726,599 | B2 | 6/2010 | Lewis et al. |
| 7,783,380 | B2 | 8/2010 | York et al. |
| 7,984,872 | B2 | 7/2011 | Kuehneman et al. |
| 8,434,709 | B2 | 5/2013 | Troutman et al. |
| 8,632,030 | B2 | 1/2014 | Troutman et al. |

(Continued)

FOREIGN PATENT DOCUMENTS

CN 207012149 U 2/2018

OTHER PUBLICATIONS

Kimberly-Clark, "Kimberly-Clark Professional™ Electronic Touchless Roll Towel Dispenser", Feb. 6, 2019, https://www.kcprofessional.com/en-us/products/paper-towels-dispensers/dispensers/09993.

*Primary Examiner* — William A. Rivera
(74) *Attorney, Agent, or Firm* — Dority & Manning, P.A.

(57) ABSTRACT

A dispenser and methods for dispensing web material, the dispenser comprising a dispensing mechanism comprising a pressure roller and a drive roller defining a nip therebetween, wherein the dispensing mechanism is configured to dispense the web material from the roll of web material in response to a user request, and wherein during the dispense a leading edge of the web material being dispensed first passes through the nip and then passes the tear bar and then out of the housing such that the leading edge is external to the housing; a jam sensor configured to detect a jam condition during or after the dispense of the web material; and wherein, in response to a jam condition, the dispensing mechanism is configured to (i) retract the web material to place the leading edge between the nip and the tear bar and (ii) then advance the leading edge past the tear bar.

20 Claims, 7 Drawing Sheets

(56) References Cited

U.S. PATENT DOCUMENTS

| | | | | |
|---|---|---|---|---|
| 8,960,588 | B2 | 2/2015 | Byrd et al. | |
| 9,480,370 | B2 | 11/2016 | Troutman et al. | |
| 2001/0001475 | A1* | 5/2001 | Formon | A47K 10/36 242/563.2 |
| 2008/0079210 | A1 | 4/2008 | Nakada et al. | |
| 2008/0190982 | A1 | 8/2008 | Omdoll | |
| 2009/0177315 | A1 | 7/2009 | Goeking et al. | |
| 2015/0157177 | A1* | 6/2015 | Carper | A47K 10/3656 242/570 |
| 2015/0313420 | A1* | 11/2015 | Tramontina | A47K 5/1217 222/63 |
| 2018/0263435 | A1* | 9/2018 | Osborne, Jr. | B65H 35/006 |
| 2020/0029750 | A1 | 1/2020 | Zimmermann et al. | |
| 2023/0248189 | A1* | 8/2023 | Osborne, Jr. | A47K 10/3625 242/564 |

* cited by examiner

PAPER PRODUCT DISPENSER WITH IMPROVED DISPENSING

TECHNICAL FIELD

The present disclosure relates generally to the field of paper product dispensers, and more particularly to electronic paper product dispensers.

BACKGROUND

Electronic paper product dispensers, including dispensers that automatically dispense a length of paper product in response to sensing the presence of a user, are present in many public washrooms and breakrooms. This type of dispenser has become known as a "hands-free" dispenser in that it is not necessary for the user to manually actuate or otherwise touch the dispenser to initiate a dispense cycle. The control systems and mechanical aspects of conventional hands-free dispensers are wide and varied.

These types of dispensers can misfeed paper or jam on occasion such that no paper is presented to a user after a dispenser cycle. Once a misfeed or jam has occurred further dispense cycles usually exacerbate the problem putting the dispenser out-of-service until a service attendant can service the dispenser and correct the problem.

SUMMARY OF THE DISCLOSURE

The present disclosure relates generally to the field of dispensers for dispensing lengths of web material from a roll, and more particularly to electronic dispensers that have improved dispensing operation including paper jam mitigation technology.

In general, one aspect of the subject matter described in this specification can be implemented in systems that include a dispenser for dispensing web material from a roll of web material, the dispenser comprising a housing comprising a back panel and a front cover and having an internal volume to house the roll of web material; a tear bar at least partially in the housing; a dispensing mechanism, at least partially in the housing, comprising a pressure roller and a drive roller, which define a nip therebetween, wherein the dispensing mechanism is configured to dispense the web material, a dispense length, from the roll of web material in response to a user request, and wherein during the dispense the web material being dispensed first passes through the nip and then passes the tear bar and then out of the housing such that a leading edge of the web material being dispensed is external to the housing; a jam sensor configured to detect a jam condition during or after the dispense of the web material; and wherein, in response to a jam condition, the dispensing mechanism is configured to (i) retract the web material a first length placing the leading edge of the web material between the nip and the tear bar and (ii) then dispense the web material a second length greater than the first length. Other embodiments of this aspect include corresponding methods and apparatus.

Yet another aspect of the subject matter described in this specification can be implemented in methods that include, in response to detecting a jam condition, driving a motor to rotate a drive roller a second direction to retract a leading edge of a web material to between (i) a nip defined between a pressure roller and the drive roller and (ii) a tear bar; and after the retracting, driving the motor to rotate the drive roller a first direction, different from the second direction, to advance the leading edge away from the nip. Other embodiments of this aspect include corresponding systems and apparatus.

Yet another aspect of the subject matter described in this specification can be implemented in systems that include a dispenser for dispensing web material from a roll of web material, the dispenser comprising: a dispensing mechanism comprising a pressure roller and a drive roller defining a nip therebetween, wherein the dispensing mechanism is configured to dispense the web material from the roll of web material in response to a user request, and wherein during the dispense a leading edge of the web material being dispensed first passes through the nip and then passes the tear bar and then out of the housing such that the leading edge is external to the housing; a jam sensor configured to detect a jam condition during or after the dispense of the web material; and wherein, in response to a jam condition, the dispensing mechanism is configured to (i) retract the web material to place the leading edge of the web material between the nip and the tear bar and (ii) then advance the leading edge of the web material past the tear bar. Other embodiments of this aspect include corresponding methods and apparatus.

Particular embodiments of the subject matter described in this specification can be implemented so as to realize one or more of the following advantages. For example, the dispenser can include a jam sensor that recognizes a jam or misfeed in the dispenser and functionality to try and self-correct the issue without requiring a service attendant to service the dispenser, which can sometimes take hours or days. If the dispenser is able to self-correct the issue then the dispenser remains in an operable condition able to dispense product to users, instead of being out-of-order until serviced by an attendant. This can lead to fewer service calls to service the dispenser, which can reduce the cost associated with operating the dispensers as the service calls can be costly, as well as increasing user satisfaction by reducing the likelihood that a dispenser goes out-of-service due to jams or misfeeds.

The details of one or more implementations of the subject matter described in this specification are set forth in the accompanying drawings and the description below. Other features, aspects, and advantages of the subject matter will become apparent from the description, the drawings, and the claims.

BRIEF DESCRIPTION OF DRAWINGS

The disclosure may be more completely understood in consideration of the following detailed description of various embodiments in connection with the accompanying drawings, in which.

Figure 1:
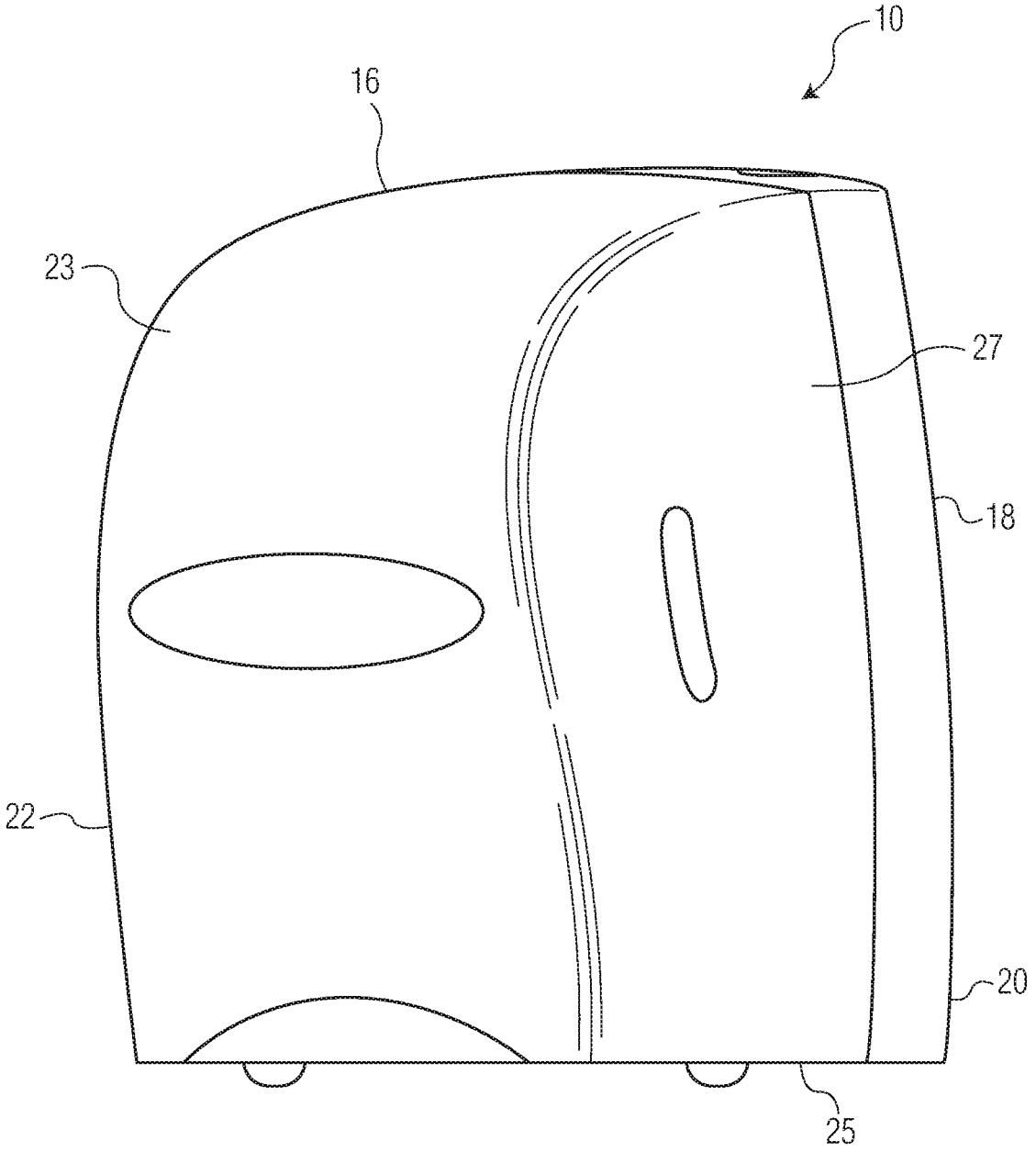
FIG. 1 is a perspective view of a representation an example dispenser.

While the disclosure is amenable to various modifications and alternative forms, specifics thereof have been shown by way of example in the drawings and will be described in detail. It should be understood, however, that the intention is not to limit aspects of the disclosure to the particular embodiments described. On the contrary, the intention is to cover all modifications, equivalents, and alternatives falling within the scope of the disclosure.

The following description should be read with reference to the drawings in which similar elements in different drawings are numbered the same. The description and the drawings, which are not necessarily to scale, depict illustrative embodiments and are not intended to limit the scope of the disclosure.

DETAILED DESCRIPTION OF THE DISCLOSURE

The present disclosure relates generally to the field of dispensers for dispensing lengths of web material from a roll, and more particularly to electronic dispensers that have improved dispensing operation including paper jam reduction/mitigation technology.

In some implementations, the dispenser includes a dispensing mechanism with a motor that can both advance the product roll (e.g., paper towel roll) to push the tail of the roll out of the dispenser to present the tail to a user to remove, for example, for hand drying, and reverse the product roll to pull the tail of the roll back towards the main body of the roll.

On occasion, when advancing the roll, the tail may become stuck or otherwise lodged inside the dispenser housing such that a paper jam results preventing the tail from being presented to a user and causing a dispense operation error. To automatically combat this issue (i.e., without the intervention of a service attendant), the dispenser has a jam sensor that can detect this anomaly and trigger a series of steps to try and clear the paper jam. For example, these steps include, in response to a jam condition being detected, the motor reversing to partially wind-up the product roll, to undo the paper jam, and then advancing the product roll a second time in an attempt to properly dispense the product. If the jam sensor senses a paper jam after this second attempt the dispense may repeat this process one or more times, e.g. according to program instructions in the dispenser's firmware, in further attempts to clear the jam. If the jam is cleared then the dispenser can continue normal operation. If the dispenser cannot clear the paper jam through this automated process, then service call from a service attendant may be in order. The dispenser and its operation are more fully described below with reference to the figures.

Figure 2A:
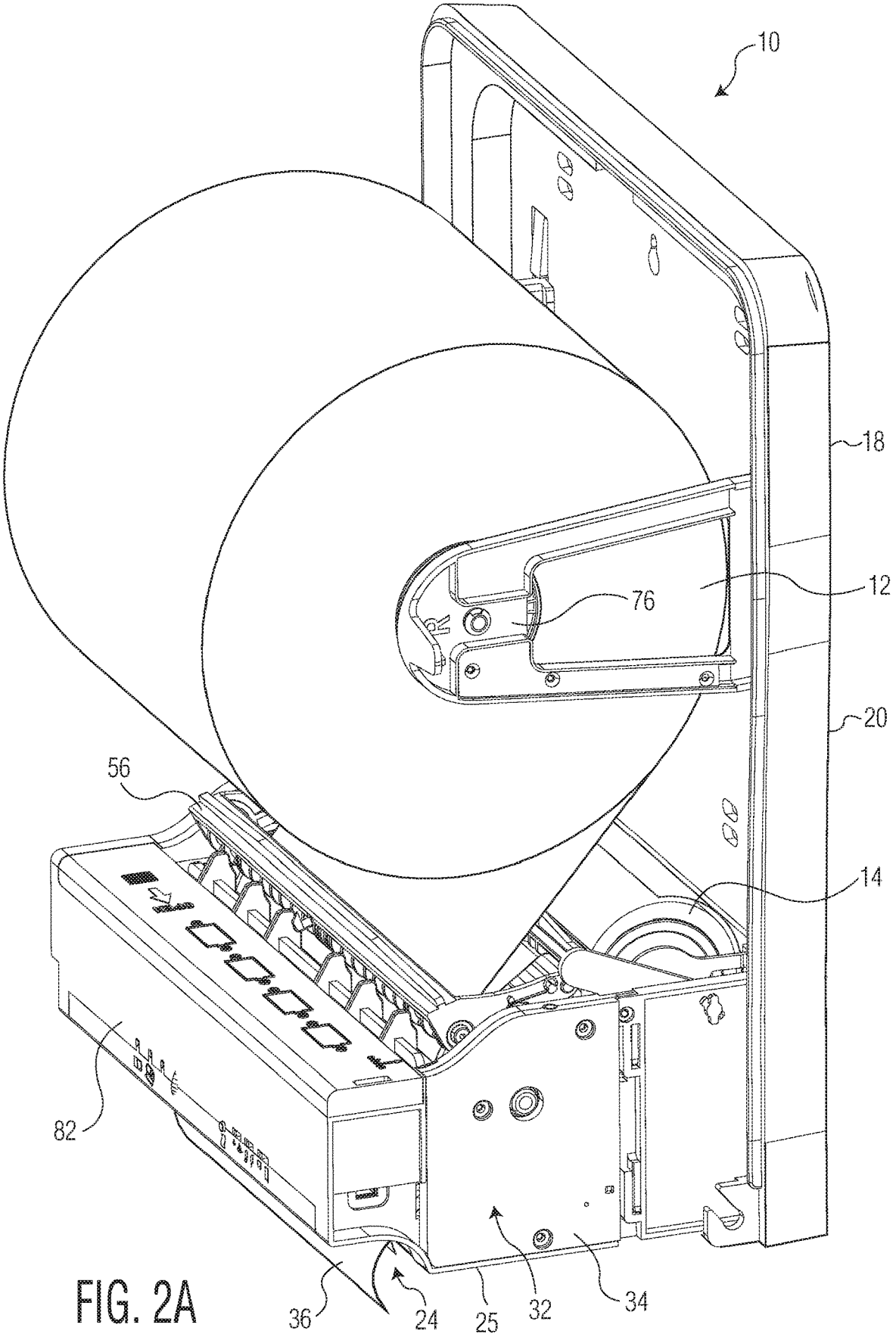
FIG. 2A is a perspective view of a representation of the example dispenser of FIG. 1 with the front cover removed.
Figure 2B:
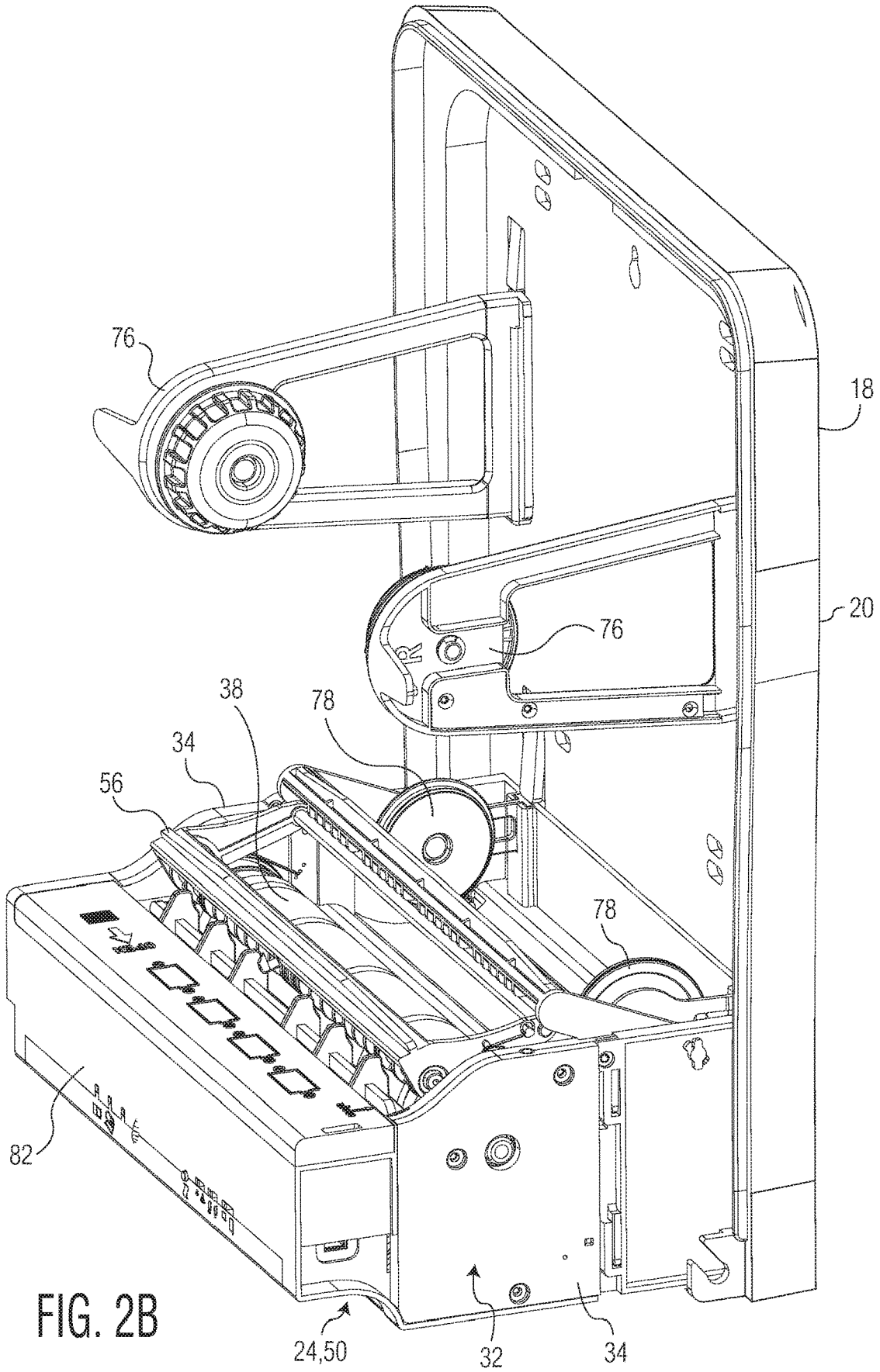
FIG. 2B is a perspective view of a representation of the example dispenser of FIG. 2A with the rolls of web material removed.
Figure 2C:
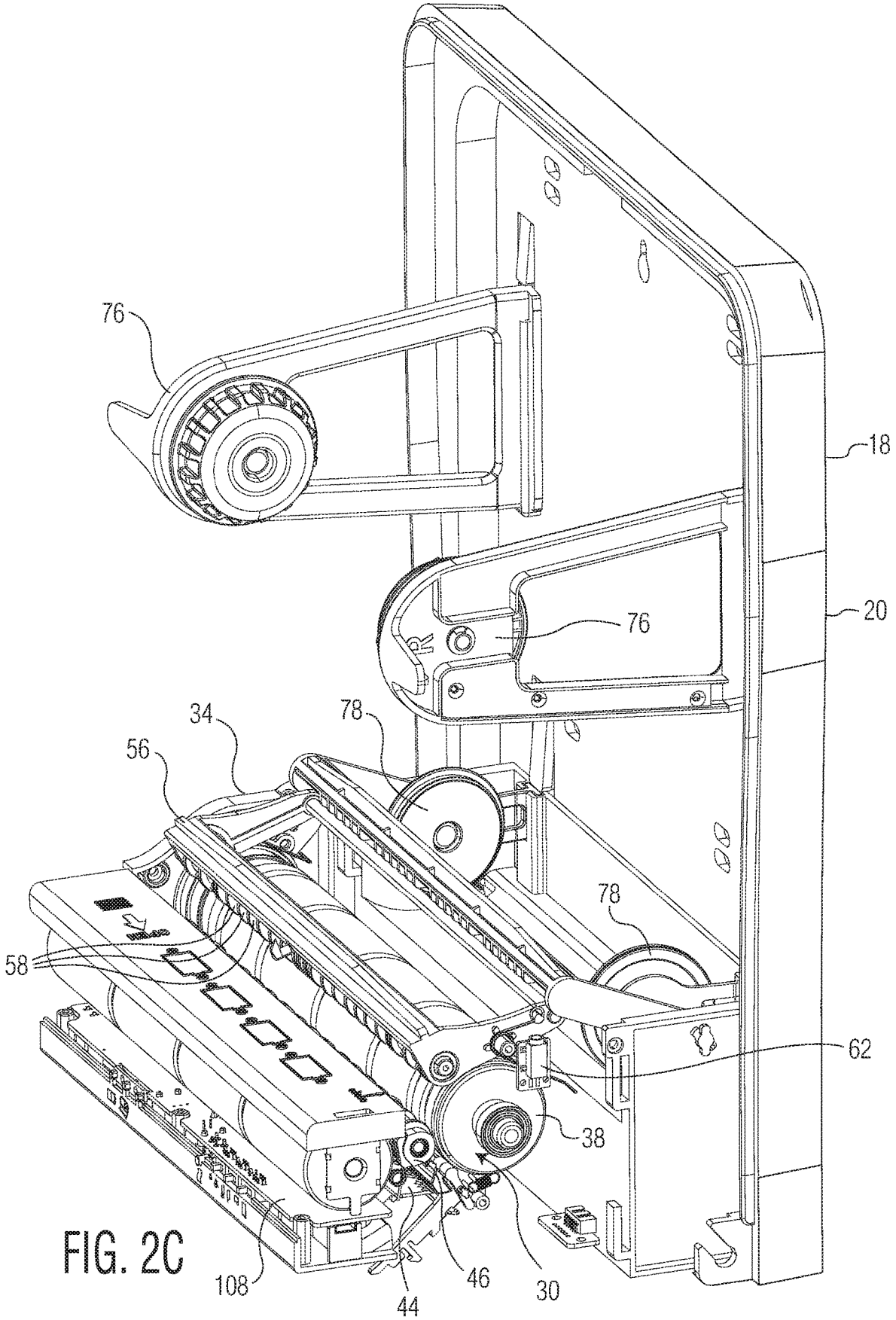
FIG. 2C is a perspective view of a representation of the example of FIG. 2B with a side wall removed.

Referring particularly to FIGS. 1-2C, an example dispenser 10 according to the present disclosure is illustrated. FIG. 1 depicts a perspective view of dispenser 10 including a housing 16 of any desired shape and configuration. In some implementations the housing is made from a composite material such as plastic or from a metal material or some combination thereof. The housing 16 can include a base 18 and a cover 22 connected to the base 18 so as to be generally releasably connected together. For example, the cover 22 may be attached to the top or bottom of the base 16 by a hinge such that the cover 22 can pivot away from the base 16 pivoting about the hinge.

FIG. 2A depicts a perspective view of the dispenser 10 with the cover 22 removed, while FIG. 2B depicts the same perspective view as FIG. 2A with the rolls of web material 12 and 14 removed. FIG. 2C depicts the same perspective view as FIGS. 2A and 2B of the dispenser 10 with the cover 22 removed and also a side wall 34 of the chassis 32 removed to further show internal features of the dispenser 10. The cover 22 may include a front wall 23 and sidewalls 27 that align with sidewalls 20 of the base 18 to define an interior volume for housing the operational components of the dispenser 10, as well as the roll or rolls of web material to be dispensed, including a main web material roll 12 and, optionally, a stub web material roll 14. Any suitable conventional locking mechanism may be provided to secure the cover 22 to the base 18. The housing 16 includes a bottom underside portion 25 with a throat 24 from which the material is dispensed.

In some implementations, the operational components of the dispenser 10 may be mounted directly onto the base 18 within the interior volume of the housing 16. In other implementations, the operational components may be connected together forming a separate removeable module which can be received in the housing 16. Such a removeable module may be readily removable from the base 18 for servicing and/or replacing components without the necessity of having to remove the entire dispenser 10 from its support surface (for example, a wall). The housing 16 may be considered as a shell into which the removeable module is inserted and removed.

Some of the internal components of the dispenser 10 include a frame or chassis 32 having left- and right-side plates 34 and a dispensing mechanism 30. The dispensing mechanism 30 may include, for example, one or more of the following components: a drive assembly comprising a drive roller 38 and a pressure roller 46, a transfer mechanism that may include a transfer arm 56, a throat assembly 50 including a the throat 24, a tear bar 44, a drive motor and gear assembly (not visible) that rotates drive roller 38, a paper jam sensor 53, and control circuitry 108. In some implementations, a motor such as that described in U.S. Patent Publication No. 20160353947, filed on Jun. 17, 2016, and titled Dispenser for Rolled Sheet materials with Motorized Spindle," can be used to rotate the drive roller 38. The '947 publication is incorporated by reference herein in its entirety for all purposes.

Left and right main web material roll holders 76 hold the main roll 12. Stub web material roll holders 78 are provided for rotatably supporting the stub roll 14 in the position within the housing 16, for example, below and rearward of the main roll 12. It should be understood that a dispenser according to the present disclosure need not be configured to dispense from a stub roll 14, and thus would not need a transfer mechanism. The dispenser 10 may be configured for dispensing from a single roll of web material. Additionally, where a stub roll 14 is included, it could be positioned in any suitable position within the housing 16.

The cutting or "tear" bar 44 may be disposed along the dispensing path of the web material upstream of the dispensing opening 24 and downstream of the nip 45 (shown in FIG. 3A) between the drive roller 38 and pressure roller 46. To separate a sheet of the web material that has been dispensed from the dispenser 10, a user grasps the sheet hanging from beneath the bottom portion 25 of the housing 16 and pulls the sheet against the tear bar 44 such that the sheet tears and separates along the line defined by the tear bar 44, as the sheet is cut by, for example, serrated edges on the tear bar 44.

The pressure roller 46 is spring biased against the drive roller 38 such that the web material passing between the nip 45 of the rollers is advanced along the dispensing path upon rotation of the drive roller 38, which can be rotated by the motor.

The dispenser 10 may include an automatic transfer mechanism to transfer dispensing of the web material from the stub roll 14 to a main roll 12 when the web material on the stub roll 14 is nearly fully depleted. From an operational standpoint, this transfer mechanism can operate substantially as described in U.S. Pat. No. 6,079,305 issued on Jun. 27, 2000, with the '305 patent incorporated herein in its entirety for all purposes. Referring to FIGS. 2B and 2C, the transfer mechanism may include a transfer bar 56 with arms pivotally mounted to the housing 18, or another component of the dispenser 10. The transfer bar 56 includes a "roller" section that may be defined by a central curved ribbed section 58. The transfer bar may further include a web retention feature retaining a leading portion of the web material of the main roll 12.

The dispenser 10 may be configured to determine an amount of web material which is on the stub roll 14. For example, the dispenser 10 may include a stub roll sensing bar (not shown) which presses against the stub roll 14. As the diameter of the stub roll 14 decreases as web material is fed out from the stub roll 14, the stub roll sensing bar may transmit one or more signals (such as to control circuitry 108) indicative of the stub roll 14 diameter. Upon detection of a certain stub roll 14 diameter, the dispenser 10 may be configured to rotate the transfer bar 56 such that the leading portion of the web material of the main roll 12 held by the bar 56 is brought by the roller section 58 into contact with the web material being dispensed from the stub roll 14. This may cause the leading portion of the material of the main roll 12 to be pulled from the arm 56 and conveyed with the web material from the stub roll 14 between the nip 45 of the drive roller 38 and pressure roller 46. The "new" web material from the main roll 12 is dispensed simultaneously with the stub roll web material until the stub roll 14 is completely depleted. If no stub roll 14 is present in the dispenser 10, the transfer bar 56 and roller section 58 contact against the web material dispensed from the main roll 12. Of course, many other suitable transfer mechanisms may be employed with the dispenser 10 such as is known in the art.

A "fuel gauge" mechanism (not shown) may be affixed to the one or more components of the dispenser 10 which tracks a remaining amount of web material of the main roll 12 as the web material is depleted. For example, a bar biased against the main roll 12 may track the diameter of the roll 12 to help in determining a remaining amount of web material on the roll 12. Alternatively, the main roll 12 may be connected to one or more weight sensors which may operate to determine an amount of web material remaining on the main roll 12 by tracking a decreasing weight of the main roll 12. Upon determining, such as by the control circuitry 108, that the remaining amount of web material of the main roll 12 is suitable for moving the roll to the stub roll 14 position, the dispenser 10 may cause an alert to be communicated to maintenance personnel that the main roll 12 is depleted and should be replaced. For example, the dispenser 10 may cause an indicator light to turn on which is visible from the exterior of the housing 16. In other embodiments, the dispenser 10 may, through a transceiver coupled to the control circuitry 108, send an electronic message (e.g. text, e-mail, or other alert) to an alert receiving device to communicate with maintenance personal about the status of the main roll 12.

A drive motor and gear assembly of the dispensing mechanism 30 may include components such as a drive shaft and a drive gear attached thereto that engages the shaft of the drive roller 38. In some implementations, upon energizing the motor, the motor causes the drive roller 38 to rotate, which pulls web material of the roll (e.g., roll 12) because the web material pinched between the pressure roller 46 and drive roller 38 in the nip 45. From the nip 45, the web material is conveyed along the dispensing path and out of the dispensing throat 24.

The dispensing mechanism 30 may be powered by batteries contained in battery compartment 82. Any suitable battery storage device or location may be used for this purpose. A conductor may be disposed in contact with the battery compartment 82 for delivering power from the batteries to the control circuitry 108 and the drive motor. Alternatively, or in addition to battery power, the dispenser 10 may also be powered by a building's AC distribution system. For this purpose, a plug-in modular transformer/adapter may be provided with the dispenser 10, which connects to a terminal or power jack port for delivering power to the control circuitry 108 and associated components. The control circuitry 108 may include a mechanical or electrical switch that isolates the battery circuit upon connecting the AC adapter in order to protect and preserve the batteries.

The control circuitry 108 may also control the length of web material dispensed. Any number of optical or mechanical devices may be used in this regard. In some implementations, an encoder 62 may be used to count the revolutions of the drive roller 38 or the motor or the pressure roller 46, with this count being (stored in the memory of and) used by the control circuitry 108 to meter the desired length of the web material to be dispensed and/or to determine how far to advance and retract the web material during the jam remediation process described below. Other systems may track the running time of the motor as the control variable, or detect perforations in the web material, and so forth.

The dispenser 10 may utilize one or more user proximity sensors 64 to detect the presence of a user in a first detection zone. In at least some embodiments, the dispenser 10 may utilize one or more further sensors 64 to detect the presence of a user in a second detection zone and, once detected, initiate a dispense sequence. The first detection zone may be oriented in front of the dispenser housing 16. The second detection zone may be oriented at least partially underneath the dispenser housing 16.

Some exemplary sensors 64 may include passive sensors such as photo sensors. Such photo sensors may be any one or combination of conventional photocells that react to changes in ambient light conditions. The operation of such devices is well known to those skilled in the art and need not be described in detail herein. Other exemplary passive sensing devices may include capacitive sensor systems that detects changes in a capacitive filed induced by the presence of a user within the monitored field.

Other exemplary sensors may include active sensors such as active transmitters and associated receivers that define an active detection zone. This active system may be any one or combination of well-known active sensing systems, such as an RF or IR sensing system. In a particular embodiment where the active sensing system 64 includes an IR transmitter and an IR receiver, the IR transmitter may emit an IR beam into the active detection zone, and the IR receiver may detect IR light reflected from an object in the active detection zone. If the amount of reflected light is sufficient (above a detection threshold value), the control circuitry 108 initiates a dispense cycle wherein a motor drives the drive roller 38 until the predetermined number of pulses (e.g., drive roller 38 revolutions) are detected/counted by the encoder 62 indicating that the correct length of material has been dispensed. The user then grasps the dispensed sheet and pulls it forward to tear the sheet against the tear bar 44.

According to some embodiments of the present disclosure, the dispenser 10 may utilize one or more passive sensors 64 and one or more active sensors 64. Such sensors 64 may be configured to, for each dispense cycle, first sense the presence of a user in the first detection zone with the one or more passive sensors 64. The presence of a user in the first detection zone may be required before the one or more active sensors 64 are enabled to initiate a dispense sequence upon active detection of the user in the second detection zone. In some implementations, the passive sensor 64 or sensors 64 must reset to a base state indicating the absence of a user in the first detection zone before the active sensor 64 or sensors 64 are enabled for a subsequent dispense sequence. This can minimize or reduce waste of the web material in that it prevents a user from standing in front of the dispenser and initiating multiple sequential dispense operations. The user must exit the area of the first detection zone prior to a subsequent dispense sequence.

In an alternate embodiment, the control circuitry 108 may define a pre-set time period between dispense sequences. This time period may be adjusted by maintenance personnel. This feature may be in addition to the requirement that the passive sensor 64 or sensors 64 must be reset to a base state. For example, a time period of three seconds may be required after the passive sensor 64 or sensors 64 have been reset.

In some implementations the passive sensor 64 or sensors 64 need not be reset to a base state, the time period may apply only to sequential activations of the active sensor 64 or sensors 64. For example, a user may stand in front of the dispenser so that the passive sensor 64 or sensors 64 see a continual "valid" detection. However, the time period must pass between sequential detections of the active sensor 64 or sensors 64. The time period may be set sufficiently long so as to discourage waste.

The dispenser 10 may include a "night sensor", such as an ambient light sensor, configured with the control circuitry 108 as a low-light sensor that shifts the dispenser to a reduced power mode in low-light conditions. In the illustrated embodiment, a photocell may be configured within the dispenser housing 16 to "look" through the housing and above the dispenser housing 16. The passive sensor 64 or sensors 64 and active sensor 64 or sensors 64 may be disabled by the control circuitry 108 in the low-light conditions. In certain situations, the ambient light detector function may not be desired. For this reason, a bypass switch may be provided and accessible such that maintenance personnel may bypass and deactivate the ambient light-sensing feature.

The control circuitry 108 may generally control the function of the dispenser 10. In some embodiments, the control circuitry 108 may be a centralized control unit, for example comprising a processor, ASIC, or microcontroller, specially adapted circuitry configured to act in a control fashion, or the like, and include memory. In such embodiments, the control circuitry 108 may be electrically connected to the various sensors and components of the dispenser 10 and configured to determine when to dispense web material, and how much, based on received inputs from the components and sensors. In other embodiments, the control circuitry 108 may comprise multiple, separate control units, each of the control units configured to make specific determinations and communicate signals to one or more other controllers. Such multiple control units may act in a coordinated fashion to control the function of the dispenser 10.

Figure 3A:
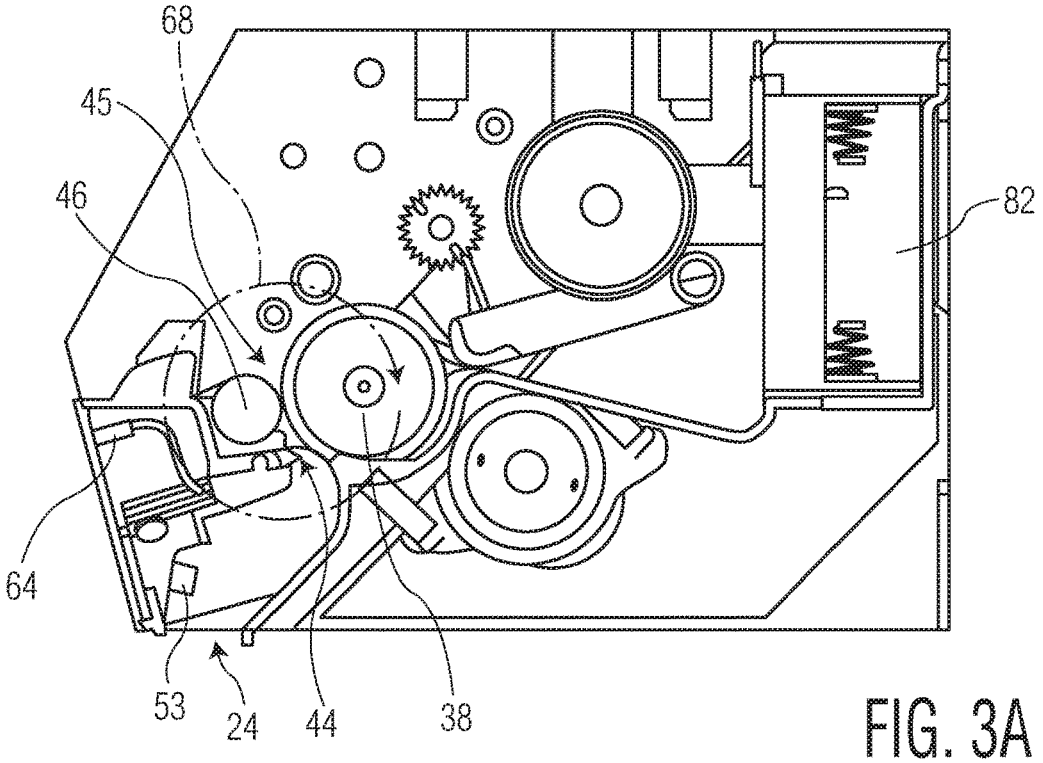
FIG. 3A is a cross-section view of representation of a portion of a dispensing mechanism of an example dispenser.

In some implementations, the dispenser 10 includes a jam sensor 53. As described above, on occasion, the web material may jam (e.g., bunch up and be prevented from traveling down the dispensing path) or misfeed from roll 12 or 14 during a dispense thereby preventing the tail of the web material (i.e., the loose end of the web material 66) from exiting the throat 24 to be accessible to a user, which is referred to as a jam condition (shown in FIG. 3C). The jam sensor 53 can detect this type of jam condition during or after the dispense of the web material from the roll 12 or 14. In some implementations, the jam sensor 53 is an optical or infrared sensor positioned along the dispensing path, and it can detect the absence or presence of the web material along the path. For example, the jam sensor 53 can be an infrared sensor positioned along the dispensing path, between the tear bar 44 and the throat 24 (as shown in FIG. 3A), and be configured to sense the presence of web material at the throat 24 as would be expected during a normal dispensing operation. In some implementations, the jam sensor 53 is in communication with the control circuitry 108 such that the control circuitry can read the jam sensor 53 (or receive signals from the jam sensor 53) to determine whether web material is present. In some implementations, in addition to or alternative a jam sensor 53 in the throat, there may be a jam sensor 53 configured to sense motor current (e.g., a high motor current above a preset threshold indicting a paper jam).

Figure 3B:
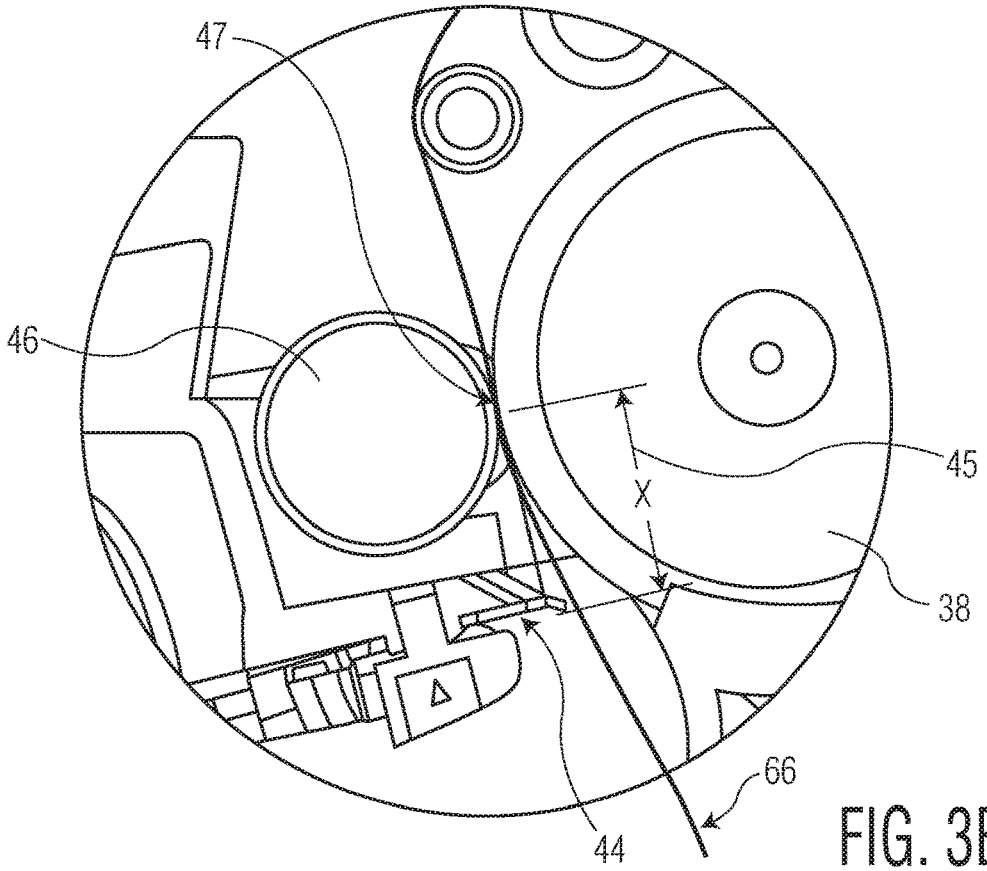
FIG. 3B is a cross-section view of an enhanced representation of a portion of the dispenser of FIG. 3A taken at section 68.

In some implementations, using the jam sensor 53 to include jam mitigation functionality, the operation of the dispenser 10 is can be described with reference to FIGS. 3B-3E. FIG. 3B is a cross-section view of an enhanced representation of a portion of the dispenser of FIG. 3A taken at section 68. More particularly, FIG. 3B shows the web material, after a normal operation dispense, having passed through the nip 45, the tear bar 44 and (although not shown) out through the throat 24. During such a normal dispense operation the motor can rotate the drive roller 38 in a first direction (e.g., counterclockwise) to feed out the web material. The control circuitry 108 can monitor the encoder 62 to count revolutions of the drive roller 38 to control how much web material is dispensed. So if the control circuitry 108 is programmed to dispense twelve (12) inches of web material is would cause the motor to rotate the drive roller 38 forty-eight (48) times. In some implementations, the number of motor rotations can be counted and used to determine how much of the web material has been dispensed. Further, for twelve (12) inches of web material to be dispensed there must be twelve (12) inches of web material below the tear bar 44. At an initial stage (e.g., loading a new roll into the dispenser 10) the drive roller 38 rotated a number of turns to advance the web material from the nip 45 to the tear bar 44, denoted as distance "X" in FIG. 3B.

To ensure that no jam occurred during the dispense, for example, in response to actuation of the motor or drive roller 38 or a signal from the user proximity sensor 64, the control circuitry 108 monitors the jam sensor 53 to determine whether the tail of the web material was properly discharged to (and impliedly out of) the throat 24. If the jam sensor 53 detects the presence of the web material at the throat 53 then the dispenser 10 continues its normal operation.

Figure 3C:
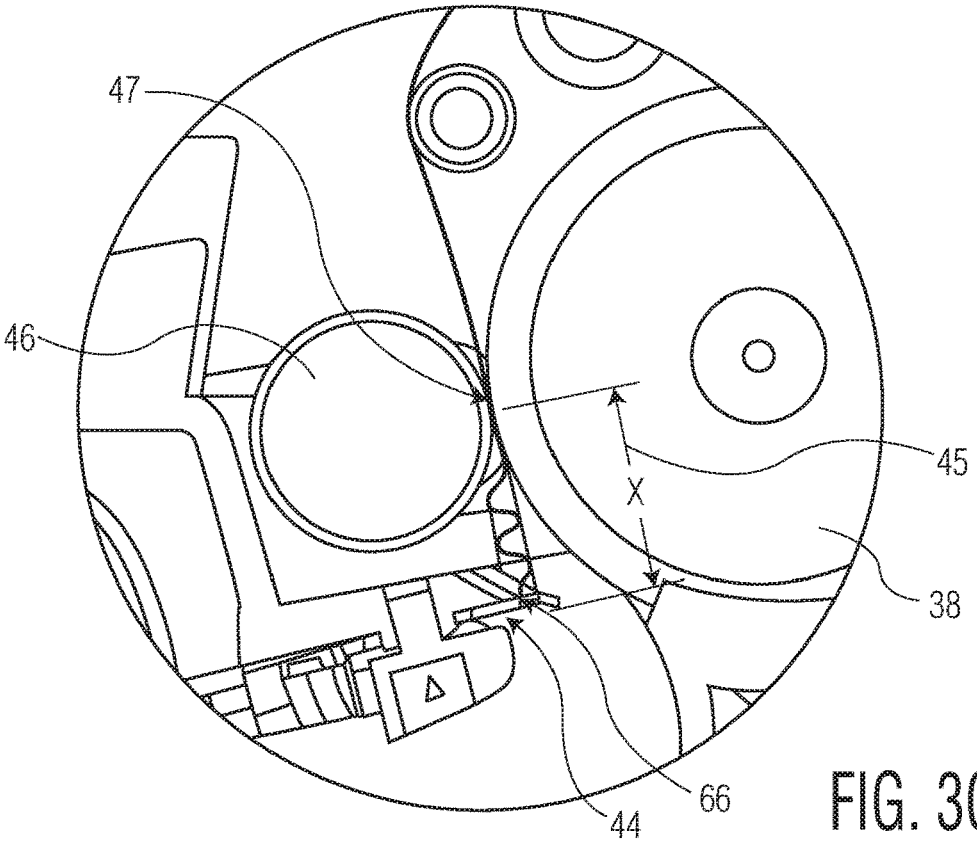
FIG. 3C is a cross-section view of a representation of a portion of the dispenser of FIG. 3B in a jam condition.

However, if the jam sensor 53 does not detect the presence of the web material (e.g., at the throat 24 or another location downstream of the tear bar 44 on the path towards the throat 24) then the dispenser 10 enters a jam mitigation mode based on the premise that the web material must be jammed or misfed in the dispensing path, as shown in FIG. 3C, where the web material has, for example, undesirably bunched up and collected behind the tear bar 44 such that it cannot properly fed out through the dispensing path and out the throat 24. The tear bar 44 is one common component on which the web material can get caught or otherwise have difficulty passing given that it partially protrudes into the dispensing path to facilitate tearing by a user pull, but at the slight expense of being a jam or misfeed point.

In one implementation, the dispensing mechanism 30, e.g., through programming in the control circuitry 108, first causes the motor to rotate the drive roller 38 to dispense an additional length of material to try to push out the jam, which would also be tracked by the encoder 62. For example, the dispensing mechanism 30 may cause an additional three (3) inches of web material to be dispensed. If the jam sensor 53 still does not detect the presence of the web material then the dispenser 10 continues in the jam mitigation mode.

The dispensing mechanism 30 then, for example, retracts the web material a first length placing the tail 66 (also referred to as the leading edge) of the web material between the nip 45 and the tear bar 44. This location, between the nip 45 and the tear bar 44, is selected, in some implementations, (i) as the tear bar 44 is a likely candidate as a jam or misfeed point as described above so retracting the web material upstream (i.e., closer to the nip 44) of the tear bar 44 eliminates this potential jam point and (ii) preventing the web material from being retracting upstream of the nip (e.g., before the web material from the roll 12 is fed into the nip) prevents web material from being released from the nip with no automated (i.e., without service attendant assistance) way to reliably re-feed the web material back into the nip 45) and thus no way to further dispense web material.

To retract the web material the dispensing mechanism 30 can cause the motor to rotate the drive roller 38 in a second direction (e.g., clockwise) to retract the web material (e.g., wind a portion of the unwound web material back loosely above the nip 45. In some implementations, the control circuitry 108 determines the first length based on the number of revolutions of the drive roller 38 or motor required to advance the web material to its current length. For example, the distance "X," the distance between the nip 45 and the tear bar 44, and/or the number of drive roller 38 or motor revolutions required to advance the web material the distance X, could be specified in the programming of the control circuitry 108. With this information and accessing the memory storing the encoder data specifying the number of drive roller 38 revolutions to cause the original dispense of, for example, twelve (12) inches and the subsequent three (3) inch unjamming attempt, the control circuitry 108 can determine the first length. For example, if the distance X is one (1) inch, the original dispense twelve (12) inches, the unjamming attempt (3) inches, and one (1) inch of dispensed web material requires four (4) drive roller revolutions, the control circuitry 108 determines that the sixteen inches of dispensed material required sixty-four (64) drive roller 38 revolutions (16 inches×4 revolutions/inch).

Figure 3D:
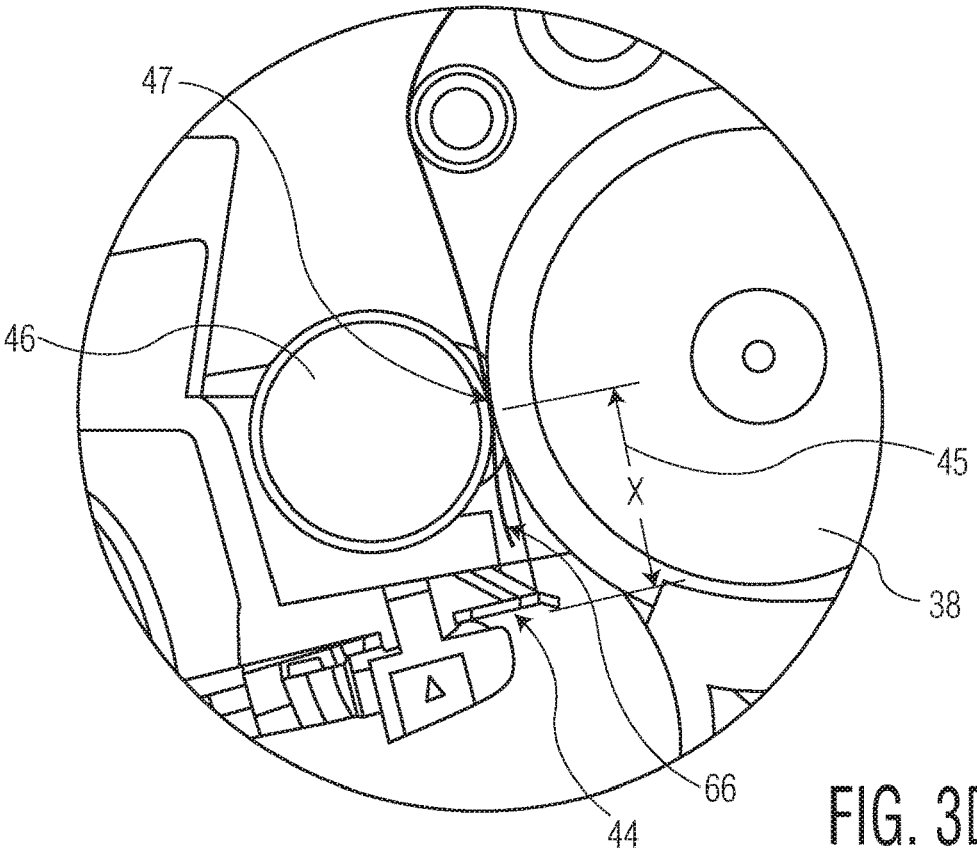
FIG. 3D is a cross-section view of a representation of a portion of the dispenser of FIG. 3B with the web material retracted.

As such, to retract the tail 66 of the web material to between the nip 45 and the tear bar 44 the dispensing mechanism 30 must rotate the drive roller 38 back to the nip 45, which would be the full (16) sixteen inches, and fifteen (15) inches, which would place the tail 66 at the tear bar 44 as the tear bar 44 is one (1) inch from the nip 45 as determined by the distance X. Thus the dispensing mechanism 30 must rotate the drive roller 38 back between sixty-four (64) (16 inches×4 revolutions/inch) and sixty (60) (15 inches×4 revolutions/inch) revolutions to place the tail 66 between the nip 45 to the tear bar 44. The first length, then, would be between fifteen (15) and sixteen (16) inches (or sixty (60) and sixty-four (64) drive roller 38 revolutions) in this example. To provide a margin of error, in some implementations, the first length will be selected such that it halves (or otherwise falls in between) the distance between the nip 45 and the tear bar 44. In this example, that would be fifteen- and one-half inches (15.5) or sixty-two (62) drive roller 38 revolutions. This retraction is illustrated in FIG. 3D, which shows that the bunching in FIG. 3C has been removed.

In some implementations, in additional to retracting the web material, the dispenser 10 may also cause the tear bar 44 to retract or otherwise move away from the dispensing path to make it easier for the web material to pass by the tear bar 44 when being dispensing. Once the tail 66 of the web material has passed the tear bar 44 the tear bar 44 can move back into its normal position. The functionality of the tear bar 44 to move or retract is described in detail in PCT Application No. PCT/US2019/059151 "ELECTRONIC TOWEL DISPENSER WITH LOW POWER MODE," which is incorporated by reference in its entirety herein.

Figure 3E:
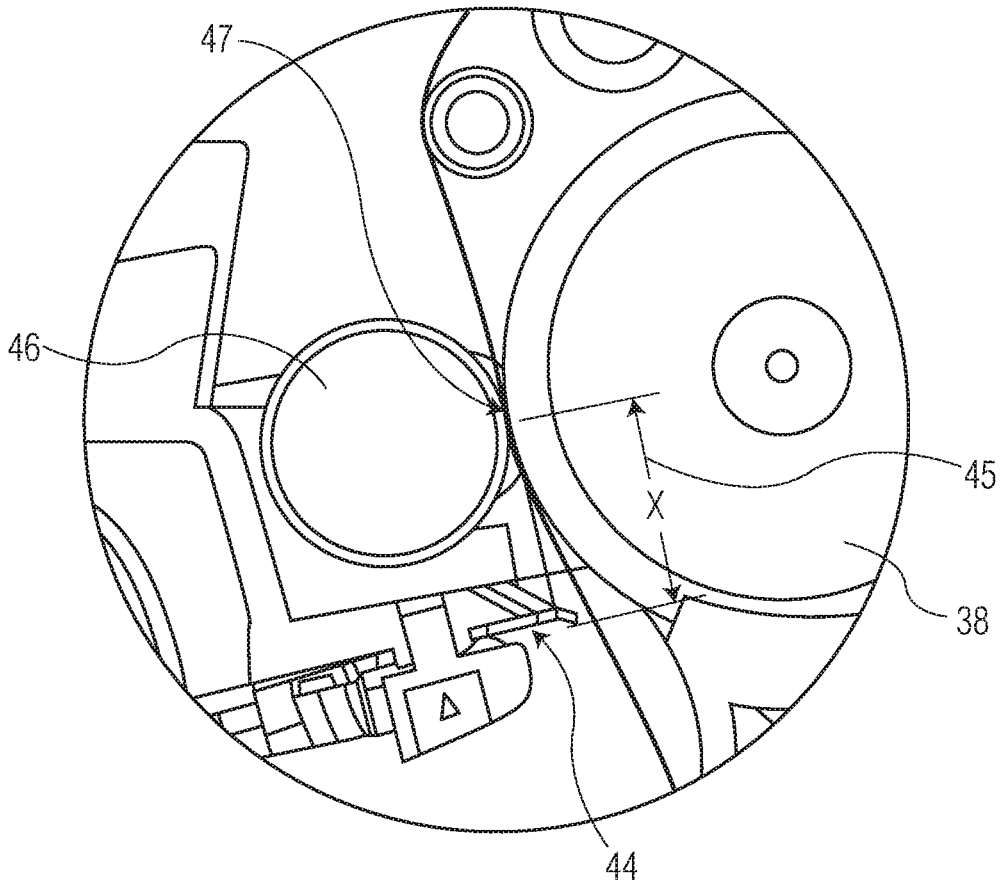
FIG. 3E is a cross-section view of a representation of a portion of the dispenser of FIG. 3B with the web material advanced after it has been retracted.

The dispensing mechanism 30 then (e.g., after the retraction) causes the web material to be dispensed a second length greater than the first length in an attempt to dispense the web material in a normal operation to place the tail 66 of the web material in a position for access by a user, as shown inn FIG. 3E. In some implementations, the dispensing mechanism 30, after the retraction, is set to cause the web material to be dispensed at least past the tear bar 44 to facilitate determining whether the jam has been cleared, e.g., as determined by whether the jam sensor 53 detects the web material (which can be configured to detect web material just after the tear bar 44 or any other location down the dispensing path towards the throat 24).

In some implementations, after a jam or misfeed is detected by the control circuitry 108, the dispensing mechanism 30 immediately proceeds to retract the web material such that the tail 66 is at a distance from the nip that is no greater than X, i.e., the tail 66 is between the nip 45 and the tear bar 44. In this implementation, there is no initial effort (i.e., before the retraction) to further advance the web material to "push out" the jam as described above.

All documents cited in the Detailed Description are, in relevant part, incorporated herein by reference; the citation of any document is not to be construed as an admission that it is prior art with respect to the present invention. To the extent that any meaning or definition of a term in this written document conflicts with any meaning or definition of the term in a document incorporated by references, the meaning or definition assigned to the term in this written document shall govern.

Those skilled in the art will recognize that the present disclosure may be manifested in a variety of forms other than the specific embodiments described and contemplated herein. Specifically, the various features described with respect to the various embodiments and figures should not be construed to be applicable to only those embodiments and/or figures. Rather, each described feature may be combined with any other feature in various contemplated embodiments, either with or without any of the other features described in conjunction with those features. Accordingly, departure in form and detail may be made without departing from the scope of the present disclosure as described in the appended claims.

EMBODIMENTS

Embodiment 1: A dispenser for dispensing web material from a roll of web material, the dispenser comprising: a housing comprising a back panel and a front cover and having an internal volume to house the roll of web material; a tear bar at least partially in the housing; a dispensing mechanism, at least partially in the housing, comprising a pressure roller and a drive roller, which define a nip therebetween, wherein the dispensing mechanism is configured to dispense the web material, a dispense length, from the roll of web material in response to a user request, and wherein during the dispense the web material being dispensed first passes through the nip and then passes the tear bar and then out of the housing such that a leading edge of the web material being dispensed is external to the housing; a jam sensor configured to detect a jam condition during or after the dispense of the web material; and wherein, in response to a jam condition, the dispensing mechanism is configured to (i) retract the web material to place the leading edge of the web material between the nip and the tear bar and (ii) then dispense the web material to place the web material past the tear bar.

Embodiment 2: The towel dispenser of embodiment 1, wherein the dispensing mechanism comprises a motor engaged to the drive roller and configured to rotate the drive roller in a first direction in response to the user request and to rotate the drive roller in a second direction, different from the first direction, to retract the web material.

Embodiment 3: The towel dispenser of embodiment 2, comprising an encoder configured to count a number of revolutions of one of the motor and the drive roller to dispense the web material the dispense length.

Embodiment 4: The towel dispenser of embodiment 3, wherein retract the web material a first length comprises rotate the drive roller in the second direction based on the number of revolutions counted to dispense the dispense length.

Embodiment 5: The towel dispenser of any of embodiments 2-4, wherein the jam sensor comprises an infrared sensor.

Embodiment 6: The towel dispenser of any of the embodiments 1-5, wherein the second length is equal to the dispense length.

Embodiment 7: The towel dispenser of any of the embodiments 1-6, wherein the roll of web material is a roll of paper towels.

Embodiment 8: A method comprising: in response to detecting a jam condition, driving a motor to rotate a drive roller a second direction to retract a leading edge of a web material to between (i) a nip defined between a pressure roller and the drive roller and (ii) a tear bar; and after the retracting, driving the motor to rotate the drive roller a first direction, different from the second direction, to advance the leading edge away from the nip.

Embodiment 9: The method of embodiment 8, wherein detecting a jam condition comprising monitoring for a presence of web material in a throat of the dispenser.

Embodiment 10: The method of embodiment 9, wherein detecting the jam condition comprises determining that the web material is not in the throat.

Embodiment 11: The method of any of embodiments 8-10, wherein driving a motor to rotate a drive roller a second direction comprises counting at least one of a number of motor revolutions and drive roller revolutions.

Embodiment 12: The method of any of embodiments 8-11, wherein driving the motor to rotate the drive roller a first direction comprises driving the drive roller to place the leading edge past the tear bar.

Embodiment 13: The method of any of embodiments 8-12, wherein driving a motor to rotate a drive roller a second direction and driving the motor to rotate the drive roller a first direction repeats multiple times.

Embodiment 14: A dispenser for dispensing web material from a roll of web material, the dispenser comprising: a dispensing mechanism comprising a pressure roller and a drive roller defining a nip therebetween, wherein the dispensing mechanism is configured to dispense the web material from the roll of web material in response to a user request, and wherein during the dispense a leading edge of the web material being dispensed first passes through the nip and then passes the tear bar and then out of the housing such that the leading edge is external to the housing; a jam sensor configured to detect a jam condition during or after the dispense of the web material; and wherein, in response to a jam condition, the dispensing mechanism is configured to (i) retract the web material to place the leading edge of the web material between the nip and the tear bar and (ii) then advance the leading edge of the web material past the tear bar.

Embodiment 15: The dispenser of embodiment 14, wherein the dispensing mechanism comprises a motor engaged to the drive roller and configured to rotate the drive roller in a first direction in response to the user request and to rotate the drive roller in a second direction, different from the first direction, to retract the web material.

Embodiment 16: The dispenser of embodiment 15 comprising an encoder configured to count a number of revolutions of one of the motor and the drive roller to dispense the web material.

Embodiment 17: The dispenser of embodiment 16, wherein retract the web material comprises rotate the drive roller in the second direction based on the number of revolutions counted to dispense the web material.

Embodiment 18: The dispenser of any of embodiments 15-17, wherein the jam sensor comprises an infrared sensor.

Embodiment 19: The dispenser of any of embodiments 15-18, wherein the roll of web material is a roll of paper towels.

Embodiment 20: The dispenser of any of embodiments 15-19 comprising a user proximity sensor configured to actuate the dispensing mechanism in response to an object entering a field of sensing of the user proximity sensor.

Embodiment 21: A dispenser for dispensing web material from a roll of web material, the dispenser comprising: a dispensing mechanism comprising a pressure roller and a drive roller defining a nip therebetween, wherein the dispensing mechanism is configured to dispense the web material from the roll of web material by rotating the drive roller in response to a user request, and wherein during the dispense a leading edge of the web material being dispensed first passes through the nip and then passes the tear bar and then out of the housing such that the leading edge is external to the housing; a jam sensor configured to detect a jam condition during or after the dispense of the web material; and wherein, in response to a jam condition:

the dispensing mechanism is configured to rotate the drive roller a specified number of revolutions in an attempt to advance the leading edge of the web material; and in response to determining a jam condition still exists, the dispensing mechanism is configured to (i) retract the web material to place the leading edge of the web material between the nip and the tear bar and (iii) then advance the leading edge of the web material past the tear bar.

Embodiment 22. The dispenser of embodiment 21 wherein a specified number of revolutions is less than a number of revolutions to dispense the web material from the roll of web material in response to the user request.

Embodiment 23. A method comprising: in response to detecting a jam condition, driving a motor to rotate a drive roller a second direction to retract a leading edge of a web material to between (i) a nip defined between a pressure roller and the drive roller and (ii) a tear bar; and after the retracting, driving the motor to rotate the drive roller a first direction, different from the second direction, to advance the leading edge away from the nip.

Embodiment 24. The method of embodiment 23 comprising in response to detecting the jam condition and prior to the retracting, driving the motor to rotate the drive roller the first direction and then determining if a jam condition still exists.

When introducing elements of the present disclosure or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements. While this specification contains many specific implementation details, these should not be construed as limitations on the scope of any invention or of what may be claimed, but rather as descriptions of features that may be specific to particular embodiments of particular inventions. Certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

What is claimed is:

1. A dispenser for dispensing web material from a roll of web material, the dispenser comprising:

a housing comprising a back panel and a front cover and having an internal volume to house the roll of web material;

a tear bar at least partially in the housing;

a dispensing mechanism, at least partially in the housing, comprising a pressure roller and a drive roller, which define a nip therebetween, wherein the dispensing mechanism is configured to dispense the web material, a dispense length, from the roll of web material in response to a user request, and wherein during the dispense the web material being dispensed first passes through the nip and then passes the tear bar and then out of the housing such that a leading edge of the web material being dispensed is external to the housing;

a jam sensor configured to detect a jam condition during or after the dispense of the web material; and wherein, in response to a jam condition, the dispensing mechanism is configured to (i) retract the web material to place the leading edge of the web material between the nip and the tear bar and (ii) then dispense the web material to place the web material past the tear bar.

2. The dispenser of claim 1, wherein the dispensing mechanism comprises a motor engaged to the drive roller and configured to rotate the drive roller in a first direction in response to the user request and to rotate the drive roller in a second direction, different from the first direction, to retract the web material.

3. The dispenser of claim 2 comprising an encoder configured to count a number of revolutions of one of the motor and the drive roller to dispense the web material the dispense length.

4. The dispenser of claim 3, wherein retract the web material comprises rotate the drive roller in the second direction based on the number of revolutions counted to dispense the dispense length.

5. The dispenser of claim 2, wherein the jam sensor comprises an infrared sensor.

6. The dispenser of claim 1, wherein dispense the web material to place the web material past the tear bar comprises dispense the web material the dispense length.

7. The dispenser of claim 1, wherein the roll of web material is a roll of paper towels.

8. A method comprising:

in response to detecting a jam condition, driving a motor to rotate a drive roller a second direction to retract a leading edge of a web material to between (i) a nip defined between a pressure roller and the drive roller and (ii) a tear bar; and after the retracting, driving the motor to rotate the drive roller a first direction, different from the second direction, to advance the leading edge away from the nip.

9. The method of claim 8, wherein detecting a jam condition comprises monitoring for a presence of web material in a throat of the dispenser.

10. The method of claim 9, wherein detecting the jam condition comprises determining that the web material is not in the throat.

11. The method of claim 8, wherein driving the motor to rotate the drive roller the second direction comprises counting at least one of a number of motor revolutions and drive roller revolutions.

12. The method of claim 8, wherein driving the motor to rotate the drive roller the first direction comprises driving the drive roller to place the leading edge past the tear bar.

13. The method of claim 8, wherein driving the motor to rotate the drive roller the second direction and driving the motor to rotate the drive roller the first direction repeats multiple times.

14. A dispenser for dispensing web material from a roll of web material, the dispenser comprising:

a dispensing mechanism comprising a pressure roller and a drive roller defining a nip therebetween, wherein the dispensing mechanism is configured to dispense the web material from the roll of web material in response to a user request, and wherein during the dispense a leading edge of the web material being dispensed first passes through the nip and then passes the tear bar and then out of the housing such that the leading edge is external to the housing;

a jam sensor configured to detect a jam condition during or after the dispense of the web material; and wherein, in response to a jam condition, the dispensing mechanism is configured to (i) retract the web material to place the leading edge of the web material between the nip and the tear bar and (ii) then advance the leading edge of the web material past the tear bar.

15. The dispenser of claim 14, wherein the dispensing mechanism comprises a motor engaged to the drive roller and configured to rotate the drive roller in a first direction in response to the user request and to rotate the drive roller in a second direction, different from the first direction, to retract the web material.

16. The dispenser of claim 15 comprising an encoder configured to count a number of revolutions of one of the motor and the drive roller to dispense the web material.

17. The dispenser of claim 16, wherein retract the web material comprises rotate the drive roller in the second direction based on the number of revolutions counted to dispense the web material.

18. The dispenser of claim 15, wherein the jam sensor comprises an infrared sensor.

19. The dispenser of claim 14, wherein the roll of web material is a roll of paper towels.

20. The dispenser of claim 14 comprising a user proximity sensor configured to actuate the dispensing mechanism in response to an object entering a field of sensing of the user proximity sensor.

* * * * *